United States Patent [19]

Conway et al.

[11] 4,234,379

[45] Nov. 18, 1980

[54] PROCESS FOR PRODUCING A UNIFORM FIBER DISPERSION AND MACHINE MADE LIGHT WEIGHT GLASS FIBER WEB MATERIAL

[75] Inventors: Bernard W. Conway, Holyoke; Nelson L. Fegley, Wilbraham, both of Mass.; James Moran, Simsbury, Conn.

[73] Assignee: The Dexter Corporation, Windsor Locks, Conn.

[21] Appl. No.: 910,881

[22] Filed: Jun. 2, 1978

Related U.S. Application Data

[63] Continuation-in-part of Ser. No. 762,492, Jan. 26, 1977, abandoned.

[51] Int. Cl.[3] ..... D21H 5/18; D21F 11/00

[52] U.S. Cl. ..... 162/145; 162/146; 162/152; 162/156; 162/216

[58] Field of Search ..... 162/145, 146, 152, 156, 162/168 NA, 168 R, 216, 202

[56] References Cited

U.S. PATENT DOCUMENTS

| | | | |
|---|---|---|---|
| 3,067,087 | 12/1962 | Gorski et al. | 162/157 R |
| 3,676,294 | 7/1972 | Opderbeck et al. | 162/350 |
| 3,749,638 | 7/1973 | Renaud et al. | 162/156 |
| 3,837,999 | 9/1974 | Chung | 162/101 |
| 4,049,491 | 9/1977 | Brandon et al. | 162/157 R |

*Primary Examiner*—William F. Smith

*Attorney, Agent, or Firm*—Prutzman, Kalb, Chilton & Alix

[57] ABSTRACT

A process of producing a uniform fiber dispersion involves the use of an in-line dispersing chamber to provide an average fiber dwell time of only about ten minutes and less. The chamber is provided with a plurality of weedless, nonthrusting impellers that generate regions of reduced pressure and flow disruptive turbulence of high intensity, the turbulence being of sufficient intensity to rapidly open fiber bundles and disperse the individual long fibers during said dwell time within said chamber. The process produces a machine-made light weight glass fiber web material of exceptionally uniform fiber distribution. The web is comprised of micron diameter glass fibers having a fiber length of about ¼ inch or more and a basis weight of about 5–30 grams/-square meter. The web material exhibits an isolated multi-fiber defect count of less than 10 per 100 square feet and a visually perceptible overall uniform fiber distribution essentially devoid of "cloud effect" fiber density variations.

17 Claims, 3 Drawing Figures

PROCESS FOR PRODUCING A UNIFORM FIBER DISPERSION AND MACHINE MADE LIGHT WEIGHT GLASS FIBER WEB MATERIAL

RELATED APPLICATION

This application is a continuation-in-part of our copending application Ser. No. 762,492 filed Jan. 26, 1977 now abandoned.

BACKGROUND AND SUMMARY OF THE INVENTION

The present invention relates generally to fiber dispersions used in papermaking and to wet-laid inorganic fibrous sheet material. More particularly, it is concerned with a new and improved process for continuously producing uniform fiber dispersions and with light weight fibrous glass webs of uniform fiber distribution made on production size papermaking machines.

Inorganic fibrous web materials, such as glass fiber papers, have been manufactured for a considerable period of time but have constantly presented the papermaker with special uniform fiber distribution problems. The same has been true for fibrous web material formed predominantly of nonglass synthetic fibers of long length. In this connection, the art has recognized that uniformity of fiber dispersion prior to sheet formation is inexorably tied to uniform fiber formation within the resultant web material. Due to the difficulties associated with achieving the necessary uniform fiber suspension, the resultant inorganic webs of fine diameter fibers were of a heavy basis weight; i.e., about 50 grams/square meter and heavier, since the heavier weight materials were sufficiently thick to mask the non-uniform characteristics of the resultant fiber array. In the typical wet-laid papermaking process, the inorganic fibers have diameters of only a few microns and, as with the nonglass synthetic fibers, are supplied to the dispersing medium in the form of bundles chopped from continuous multiple filament strands. The dispersing medium for glass fibers is usually an acidic aqueous solution and may be slightly viscous in order to promote and maintain the dispersion and isolation of the individual fibers within the multiple filament bundles. Typically, the fibers are placed within the dispersing medium and are agitated within a beater or pulper to effect bundle separation whereupon the stock is conveyed to holding tanks containing conventional mixing units to maintain the fibers within their desired suspended or dispersed condition. As can be appreciated, failure to provide sufficient agitation during the initial dispersion of the fibers causes incomplete separation of the individual fibers and fiber bundles are visible within the resultant continuous sheet material.

In recent years, glass and low denier nonglass synthetic fibers longer than conventional papermaking length; namely, fibers having a length of between about $\frac{1}{4}$ inch to one inch and more have been used. However, when these fibers have been dispersed in accordance with the prior known technique, it was found that the individual fibers tended to cling together and snag within the beater and holding tanks and could not easily be redispersed, resulting in clumps or other irregularities within the sheet product. It was also found that the long glass fibers reaccumulated in such a manner as to form multi-fiber groupings exhibiting the configuration of a haystack or spider. Although these "haystacks" can be tolerated in the heavy weight materials and for certain applications where the aesthetic appearance of the sheet material is not of concern, they are considered major defects in light weight materials and for those applications where the glass sheet provides a surface veil or is intended to provide a smooth surface of a reinforced plastic structure.

The thicker, heavy weight glass sheets have been used in vinyl flooring tile and the like to provide dimensional stability. However, the heavy weight glass material has poor resin penetration characteristics and, therefore, poor lamination, resulting in a tendency of the tiles to delaminate. Thin, light weight, hand sheets having good fiber distribution can be individually formed when appropriate care is taken. However, the uniform fiber distribution necessary to provide for elimination of the visually perceptible, overall density variation referred to as the "cloud effect," coupled with substantial minimization of isolated multi-fiber defects or "haystacks," has not been achieved on continuous papermaking machines when producing light weight glass fiber web material.

In a continuous papermaking operation on a production basis, long fiber sheet material is typically produced from very dilute fiber suspensions using an inclined wire or similar type of papermaking machine. In such machinery, there is used a conventional open type headbox of sufficient volume to establish a calm and relatively placid fluid approach to the web forming zone. The advantage of such a headbox is that sufficient time is provided in the headbox for the release of air bubbles from the fiber suspension prior to web formation. However, the desired calm and placid fluid approach has a distinct disadvantage for long glass fiber suspensions. It has been found that as the air bubbles are released at the headbox, they tend to permit and even encourage the formation of fiber "haystacks". The bubbles carry these multi-fiber groupings to the surface of the web material as it is being formed. This provides not only an unacceptable sheet material from a visual appearance standpoint, but also produces an irregular or roughened surface feel that is readily detected by simply passing a hand across the surface of the sheet material.

Accordingly, it is a primary object of the present invention to provide a new and improved process for continuously producing a uniform and homogeneous dispersion of long fibers well suited to the formation of essentially defect-free wet-laid fibrous web material.

Another object of the present invention is to provide a new and improved process of the type described that provides for rapid dispersion of long man-made fibers within a region or zone of high intensity turbulence. Included in this object is the provision for maintaining such a turbulent zone while passing the fibers therethrough for accelerated dispersion.

Still another object of the present invention is to provide a new and improved process of the type described that facilitates rapid and complete dispersion of very long fibers in a continuous flow-through operation by the use of a nonstapling mixing impeller that generates a zone or region of reduced pressure coupled with high intensity turbulence. Included in this object is the provision for a process applicable to both inorganic and organic fibers of long length.

It is a further object of the present invention to provide a new and improved long fiber glass web material of extremely light weight yet of uniform fiber formation that is produced on production size papermaking machinery.

Yet another object of the present invention is to provide a new and improved glass fiber web material of the type described that exhibits a visually perceptive, overall uniform fiber distribution and a minimum of isolated multi-fiber defects. Included in this object is the provision for a light weight glass sheet material of continuous length that is essentially devoid of visible "cloud effect" fiber density variations.

Still another object of the present invention is to provide a light weight glass fiber material that exhibits improved aesthetic and physical properties and renders the material well suited for use in reinforced plastic films, tiles and the like.

Other objects will be in part obvious and in part pointed out more in detail hereinafter.

These and related objects will be achieved in accordance with the present invention by providing a continuous process of producing a uniform fiber dispersion for wet papermaking operations from bundles of long fibers. The process comprises the steps of: (1) providing an initial fiber slurry consisting essentially of a dispersing liquid having a viscosity of at least about 2 cps and long fibers in the form of at least partially unopened fiber bundles, the fibers in said bundles having a fiber length of ¼ inch and more and a length to diameter ratio of about 400 to 3000; (2) continuously flowing said fiber slurry through an in-line dispersing chamber provided with a plurality of nonstapling impellers having an impeller size relative to the capacity of the chamber of at least 0.1 in./gal., said impellers being adapted for generating trailing regions of reduced pressure and flow disruptive turbulence of high intensity, said slurry being fed continuously through said chamber at a throughput rate sufficiently faster than conventional papermaking fiber dispersing chambers to provide a chamber dwell time of only about ten minutes and less and a dispersion factor greater than 0.005, said factor being the quotient of said impeller size and the throughput rate of said slurry in tons per day; (3) subjecting said slurry to said regions with said turbulence being of sufficient intensity to rapidly open the fiber bundles and disperse the individual fibers during said dwell time within said chamber; and (4) removing the dispersed fibers and liquid from the chamber as a substantially uniform and homogeneous fiber dispersion for subsequent web formation in a wet papermaking operation. The objects are further achieved by providing a light weight inorganic fiber web material comprised of micron diameter inorganic fibers having a fiber length of about ¼ inch or more and a minor amount of a binder for the inorganic fibers. The web material has a basis weight of about 5–30 grams/square meter, a microvariation in basis weight of less than 10%, a macrovariation in basis weight of less than 5% and an isolated multi-fiber defect count of less than 10 per 100 square feet wherein each defect is an agglomeration of fibers causing a local difference in web thickness of 0.5 mils and more. Further, the web exhibits a visually perceptible overall uniform fiber distribution essentially devoid of "cloud effect" fiber density variations.

A better understanding of this invention will be obtained from the following description and the accompanying drawing of the process including the several steps and the relation of one or more of such steps with respect to each of the others and the article of manufacture possessing the features, characteristics, compositions, properties and relation of elements described and exemplified herein.

DESCRIPTION OF THE PREFERRED EMBODIMENT

Figure 1:
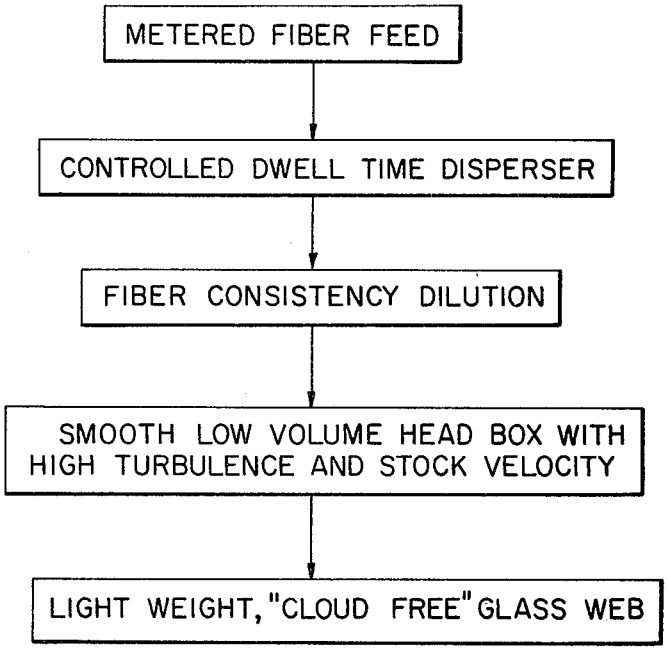
FIG. 1 is a block diagram of a preferred technique used in forming the light weight web material of the present invention.

As mentioned hereinbefore, a major factor in obtaining the desired uniform fiber distribution within the resultant sheet product is the achievement of a complete and uniform dispersion or suspension of the fibers within the dispersing medium and the conveyance of that dispersion intact to the forming area. Thus, for clarity of description and ease of understanding, the present invention will be described in connection with the preferred technique or method employed, particularly with respect to its use in forming the new and improved glass web material.

Numerous factors affect the quality of an aqueous fiber dispersion and its ability to be fed to the forming area of a papermaking machine. Among these are the type of fiber, including the fiber finish and the condition of the strand rovings used to supply the fibers, the chopping or cutting performance, the composition and characteristics of the dispersing medium, the performance of the mixing or dispersing apparatus and the treatment of the fiber stock material after it leaves the disperser. Although each of these factors is important, it has been found in accordance with the present invention that a substantial and significant factor is the intensity of the fiber separating turbulence and the dwell time of the fibers within the system between the points at which they enter and leave the disperser and, in the case of glass fiber dispersions, the additional time between the disperser and the point at which they are removed from the dispersion at the web forming zone of the papermaking machine.

In accordance with the present invention, it has been determined that best results are achieved by completely eliminating the holding tanks utilized heretofore and by using a flow-through in-line disperser that provides high intensity turbulence rather than the batch mixers employed in the past. In conjunction with the elimination of the holding tanks is the immediate conveyance of the dispersed glass fibers to a dilution station and the utilization of a smooth, low volume or short headbox characterized by high turbulence and high stock velocity. In such a system the flow of the fiber suspension from the disperser to the forming area of the papermaking machine occurs within a matter of a few seconds and the dwell time within the disperser is a major time-controlling factor for the passage of the glass fibers through the system. Such time control is important since it has been found that optimum dispersion of long fibers is reached relatively quickly, that is, within about one to two minutes, and is maintained in its most uniformly dispersed condition for a period of only four to five minutes. Thereafter, long fibers, particularly the thin flexible glass fibers, tend to accumulate, cling to each other or form the undesirable "haystacks" or multi-fiber bunches mentioned hereinbefore. It will, of course, be appreciated that the wet papermaking process is a dynamic system which is affected by numerous other conditions or factors within the system, such as the viscosity of the dispersing medium, the fiber consistency, the rate at which the fibers are metered into the disperser and numerous other process variables. Consequently, the exact dwell time will vary depending on these various conditions or factors. However, best results have been achieved with controlled dwell times within the disperser of less than ten minutes and generally from about one to seven minutes. An acceptable operating range falls between approximately two to six minutes, while the preferred dwell time is about two and one-half to five minutes.

Although the inorganic fibers that may be used in the present invention include substantially all of the conventional inorganic materials commercially available in fiber form, such as asbestos, mineral wool and the like, glass fibers are generally preferred. The fibers will vary substantially in thickness, although in the preferred embodiment the fiber diameters are within the coarser fiber range such as between about 5 microns and 15 microns. It will, of course, be appreciated that somewhat finer or coarser diameter fibers may be used for particular applications. The glass fibers constitute the major portion of the fiber content and preferably account for as much of the fiber content as possible. Thus, about 85–90 percent or more the fibers within the sheet structure are inorganic and, preferably, glass fibers. As exemplified herein, mixtures of different types and sizes of glass fibers may be employed or the sheet can be formed from only a single type and size of glass fiber.

Due to the type of preferred glass fibers utilized, it is generally desirable to provide a binder in the inorganic sheet material. Although a binder can be applied as a dilute solution after the web is formed or can be incorporated within the fiber furnish as a portion of the dispersing medium, it is generally preferred to provide binder fibers which constitute up to about 10–15 percent of the total fiber content and preferably about 5 to 10 percent thereof. Various binder fibers can be used with good results. Among these, polyvinyl alcohol fibers have been found to produce superior results relative to post formation spraying with adhesives and the like. The binder fibers also enhance the handling characteristics of the web through the papermaking machine. Preferably, the fibers are activated or at least softened in the drier section of the machine to provide the sheet material with its desired structural integrity.

The binder fibers are preferably added to the fiber suspension during or after dilution of the fiber consistency and prior to the flow of the suspension to the headbox of the papermaking machine. Thus, the polyvinyl alcohol fibers which act as the binder component of the inorganic fiber web can be added conveniently at an adjustable speed fan pump downstream of the dilution operation without interfering with the dispersion of the glass fibers within the uniformly dispersed fiber stock material. If desired, subsequent size press treatment or other binder treatments can be utilized depending upon the particular end use for which the sheet material is intended.

The process of the present invention is not limited to inorganic fibers. Long fibers made from synthetic man-made organic materials may also be employed with good success. Thus, man-made fibers such as nylon, rayon, polyvinyl acetate, polyester, polyolefins and the like, or combinations thereof, may be used. Such synthetic fibers typically constitute the major fiber component together with lesser amounts of natural fibers but may be used exclusively as the only fiber component. The fibers are long; i.e., greater than $\frac{1}{4}$ inch in length, and may be of very fine denier. Thus, materials of 1.5 denier yet of $\frac{3}{4}$ inch or more in length can be readily employed. Although these long, thin and flexible fibers typically exhibit a length to diameter ratio of about 700:1 to 2000:1, with excellent results being obtained at ratios of 1000:1 to 1600:1, fibers falling within the broad ratio range of 400:1 to 3000:1 may be used. Typical examples of the preferred materials are 1.5–1.8 dpf rayon or polyester fibers of $\frac{3}{4}$ inch length and 6 dpf polyester fibers of 1 inch and $1\frac{1}{2}$ inch lengths. These long fibers provide increased tensile and tear strength, require less binder and permit greater mechanical treatment of the web even in its wet condition.

Referring now specifically to the drawing, it has been found desirable in the preferred technique to provide a controlled or metered feed of the long fibers in order to achieve the best fiber dispersion characteristics. The fibers are preferably metered at a selected rate into a continuous in-line disperser and from the disperser are fed directly to the dilution and forming area of a conventional papermaking machine. This arrangement obviates the need for retaining the dispersed fibers within a stock chest or other holding tank and the resultant deterioration of the quality of the dispersion. Additionally, it is an advantage of the present invention that the continuous dispersing equipment used herein is of relatively simple construction and inexpensive compared to conventional bulky stock preparation equipment. If desired, the fibers can be precut and fed by a dry fiber meter, can be premixed in a dispersing medium or can be fed as continuous strands and cut or chopped as they are delivered to the in-line disperser.

Figure 2:
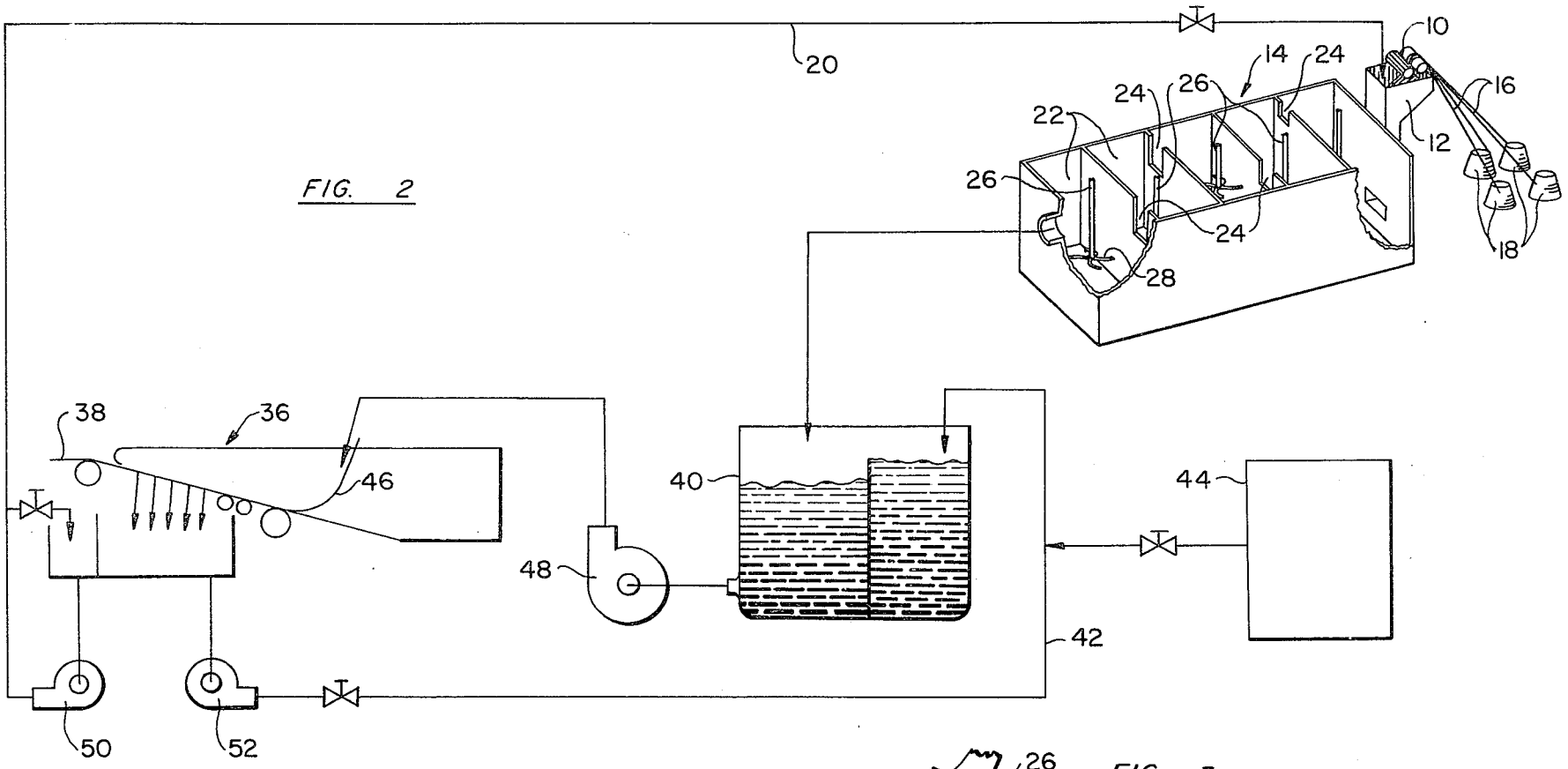
FIG. 2 is a schematic diagram of the process of FIG. 1 including an illustration of a preferred in-line disperser and headbox.

In the preferred embodiment shown in FIG. 2, it has been found advantageous to provide a cutter, such as the two roll cutter 10, mounted above the inlet hopper 12 to the disperser 14 so that continuous lengths or filaments 16 of glass rovings or synthetic fiber strands can be fed from spools 18 and cut for immediate delivery to the disperser. This delivery of the continuous filaments provides excellent control over both the fiber length and the rate at which the fibers are fed to the disperser. Additionally, it provides flexibility by permitting the utilization of different fiber lengths and adjustable control over the fiber lengths. As shown, the liquid dispersing medium is also fed to the disperser 14 from line 20 through the inlet hopper 12.

Where prechopped or precut fibers are employed, it is possible to provide control over the fiber feed rate to the disperser by employing a weigh belt or the like between a dry fiber meter such as cutter 10 and the fiber disperser 14, in which event the dry fiber meter functions as a pre-feeder with its speed modulated and controlled by a signal from the weigh belt in order to achieve the desired feed rate for the fibers. Alternatively, the fibers may be premixed in a dispersing liquid to provide an initial fiber slurry of known consistency that may be metered into the in-line disperser. In such a slurry, a portion of the fibers already are dispersed but many fibers are in the form of partially unopened fiber bundles.

As mentioned, the fluid used as the dispersing medium also is fed by line 20 to the inlet chute 12 of the disperser 14 to provide the desired fiber consistency therein. When dispersing long fibers of any type, it is preferred that the dispersing medium contain a sufficient amount of a viscosity modifying agent. Typically, the solution exhibits a viscosity above 2 centipoise and more and is usually between about 5 and 20 centipoise. The viscosity producing agent may be a natural material, such as gums, or a synthetic material, such as hydroxyethylcellulose, or some other resin as well as blends or combinations thereof. The agents are preferably water soluble materials which can be used alone or in combination with other materials to provide the desired viscosity. Examples of natural gum materials are locust bean gum and guar gum derivatives. Among these, the guar gum derivatives are preferred, and excellent results have been obtained with an aqueous solution of a guar gum derivative sold by General Mills Company under the tradename "Gendriv." In addition to the natural viscosity modifiers, it is also possible to utilize synthetic materials, such as high molecular weight resins, dispersants, surfactants and the like, to control the properties of the dispersing medium. These synthetic materials are preferably water soluble and are stable within the acidic environment utilized for the glass fibers. Among the synthetic viscosity producing materials, the preferred resins are polyacrylamide polymers which can be used in dilute aqueous solutions at low concentration (e.g., 0.025–0.2 percent) to provide the desired control over the viscosity. Typical of such materials is the polyacrylamide resin sold by Dow Chemical Company under the tradename "Separan AP-30" and by American Cyanamide Company under the tradename "Cytame 5." An example of the hydroxyethylcellulose employed is the water soluble material sold by Hercules Chemical Company under the tradename "Natrosol."

The viscous dispersing medium is utilized since it prevents fiber entanglement of the long, thin flexible fibers during the dispersing operation and assists to maintain the fibers in their dispersed state during passage of the suspension through the disperser. As will be appreciated, the viscosity of the solution will affect the dwell time required and must be adjusted for the particular fiber and fiber consistency utilized. A high viscosity medium and a short dwell time might lead to an under-dispersed fiber stock, while a low viscosity and a long dwell time could lead to over-dispersion and the formation of "haystacks" and other major defects. A viscosity in the range of about 5–10 centipoises and a dwell time of about 2.5–5.0 minutes has been found to produce good dispersion results. When dispersing glass fibers, the medium is an acidic aqueous solution that also may contain a suitable agent for controlling the viscosity. Thus, in accordance with the preferred embodiment, an aqueous solution of dilute sulphuric acid having a pH of between about 2 and 4 is employed. As will be appreciated, other additives, such as dispersing aids, e.g., surfactants, such as sodium hexametaphosphate sold under the tradename "Calgon," may be added to the dispersing medium in order to achieve the desired control over the dispersed fibers and to assist in preventing the recombination of fibers into the undesirable haystack configurations.

As mentioned, it has been found that the fibers are dispersed quite rapidly within the dispersing medium and reach a peak of percent fibers dispersed within a relatively short time following which the fibers, particularly glass fibers, tend to cling or bind together slightly to form the undesirable "haystacks." Thus, upon reaching optimum dispersion, it is desirable to maintain the agitation for a limited period of time and control the dwell time of the fibers within the disperser so that prolonged agitation is avoided. In this connection, it has also been found that even after the optimum dispersion has been reached at the desired dwell time, the agitators within the disperser cannot be shut off without damage to the quality of the dispersion. Of course, as will be appreciated, surface treatment of the fibers will substantially affect the ability of the fibers to tolerate a prolonged dwell time. However, for most glass and synthetic fibers presently available on a commercial basis, it has been found that the optimum dwell time is between 2½ and 5 minutes when operating with a dispersing medium having a viscosity of about 5–10 centipoises. For glass fibers, the dispersing liquid should have a pH of about 2–3 at a slightly elevated solution temperature of approximately 80°–100° F. and a fiber consistency of about 0.3–1.0 percent by weight.

Preferably the disperser should be of the type that exhibits a relatively smooth interior surface and is free of any edges or surfaces on which the long glass or synthetic fibers can snag or drape. However, the disperser may consist of a plurality of mixing or dispersing stations or compartments with continuous flow directly from station to station in order to provide the desired dwell time characteristics. A characteristic feature of the disperser of the present invention is its compact area of high intensity turbulence. This is generated by providing a large impeller relative to the volume of the impeller compartment and a rapid throughput or low dwell time for the fiber slurry passing continuously through the disperser. Rather than providing an inordinately large impeller in a conventional papermaking chest, it is preferred that the in-line disperser be substantially smaller, simpler and less expensive than such equipment. The smaller size also has the advantage of requiring lesser quantities of fibers in the system at any one time.

Figure 3:
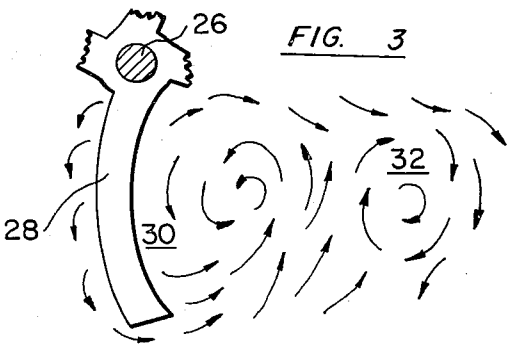
FIG. 3 is an enlarged view, partially broken away and partially in section, of an impeller used in the dispenser of FIG. 2 illustrating the trailing high intensity turbulence generated during operation of the impeller.

As shown in FIG. 2 of the drawing, an in-line disperser 14 that has provided excellent results may consist of a generally rectangular dispersing cabinet divided into five or more individual compartments 22 interconnected by flow gates 24 which direct the flow of the fiber slurry progressively from one compartment to the next as it passes continuously through the disperser. Each compartment may contain one or more agitators or impellers 26 for generating the high intensity, violent agitation considered necessary for breaking up the fiber bundles and forming the homogeneous and uniform dispersion thereof within the dispersing medium. In the preferred embodiment, the impellers 26 are provided with non-thrusting blades, such as the paddles 28, so that they do not necessarily drive or assist in the flow of the slurry through the compartment 22. Instead, the impellers should be such as to create a large area of high intensity turbulence throughout the full extent of the compartment whereby the slurry in flowing through the compartment is subjected to this high intensity turbulence causing the fiber bundles to break apart into their individual fiber components. The impellers also should be of a nonstapling configuration which prevents individual fibers from being caught on the blades of the impeller and collected thereon in the form of bundles, snags, etc. One such arcuately swept, broadfaced, blade paddle configuration is depicted in FIGS. 2 and 3, the latter illustrating the generation of a wake zone 30 of reduced pressure immediately behind the impeller blade 28 and a trailing convulsing turbulent flow 32 which acts on the fibers within the chamber 22.

As mentioned, it is a feature of the present invention that the impeller blade exhibits a size or radial sweep that is inordinately large relative to the volume or capacity of the compartment housing the impeller. For example, a conventional papermaking chest having a capacity of about 15,000 gallons may utilize a blade having a diameter of approximately thirty inches for mixing a fiber dispersion, thus providing a relative impeller ratio; i.e., an impeller blade diameter divided by the capacity of the chest, of about 0.002 inch per gallon. The in-line disperser of the present invention, on the other hand, should exhibit a relative impeller ratio of at least 0.1 inch per gallon and typically will have a relative impeller ratio of about 0.2 to 1.0 inch per gallon. As can be appreciated, the substantially reduced volume relative to the diameter of the agitator will result in an extremely violent and turbulent condition of high intensity within the individual compartments of the dispersing chamber. Additionally, since the impeller is not of an axial thrusting type, it does not tend to rapidly accelerate the slurry through the zone of high turbulence but permits sufficient time for the turbulence to act on the fiber bundles. The fibers are constantly subject to the turbulence while in the compartment since the relative size of the compartment and its shape avoid the presence of quiet areas within the compartments.

As mentioned, the relative impeller ratio should be combined with a rapid throughput or low dwell time for the fiber slurry passing through the dispersing chamber. In this connection, it has been found that a dispersion factor greater than 0.01 should be achieved to provide the desired uniform and homogeneous fiber dispersion. The dispersion factor is the quotient of the relative impeller ratio and the throughput rate of the slurry in tons per (twenty-four hour) day. For example, a conventional papermaking chest having a relative impeller ratio of 0.002 and a throughput of approximately 20 tons per day will exhibit a dispersion factor of 0.0001. The in-line disperser of the present invention, on the other hand, exhibits a dispersion factor that is larger by at least tenfold and more. As will be appreciated, the dispersion factor increases as the relative impeller size increases and is substantially greater than 0.005. In fact, it ranges in size from about 0.01 to about 2.0, with the preferred factor being at a level of about 0.05 to 1.0. For example, the in-line disperser having a typical relative impeller ratio between 0.2 and 1.0 and operating at a throughput of about 2 tons per day will have a dispersion factor of about 0.1 to 0.5.

In the specific embodiment of the disperser shown in the drawing, it should be noted that the individual compartments 22 within the dispersing chamber are of substantially the same size and are of rectangular configuration so that the walls of the compartment act as turbulence-enhancing baffles that tend to prevent the generation of a vortex or spiraling flow of the slurry through the chamber. This, in turn, assures contact of the fibers and particularly the fiber bundles with the turbulent force components generated by the impellers.

As will be appreciated, the specific design of the disperser can vary so long as it achieves the desired characteristics and functions of effectively separating the individual fibers from the fiber bundles fed to the disperser. This should be accomplished within the designated dwell time to produce a uniform dispersion of the individual fibers while rapidly conveying the fiber dispersion through the disperser. As mentioned, the fibers preferably are metered into the dispersing medium flowing through the disperser to provide the desired fiber consistency. Usually the consistency is substantially higher than the fiber consistency within the headbox by a factor of as much as 10–100 times. In accordance with the preferred embodiment, the fiber consistency is less than two percent and generally is in the range of about 0.3–1.3 percent with a preferred range of about 0.5–0.9 percent.

As mentioned hereinbefore, the fiber dispersion moves rapidly from the disperser to the forming portion 36 of the papermaking machine and, in fact, reaches the forming wire 38 within a few seconds after leaving the disperser. However, during that period the fiber consistency of the dispersion is adjusted so as to more fully dilute the fiber stock. This can be achieved by feeding the dispersion to a separate flow-through mix tank 40 where it is mixed with the main white water discharge flowing thereto through conduit 42 from the web forming operation. The fiber consistency is diluted from a value of 0.3–1.3 percent to a value of about 0.005–0.05 percent. Thus, as can be seen, the dilution is greater than 10 to 1 and usually 15–25 to 1 in order to provide the highly dilute fiber suspension fed to the headbox of the papermaking machine. As shown, additives such as viscosity modifiers and other adjustments can be controlled by appropriate additions to the white water from tank 44 into conduit 42.

As indicated in the drawing, the headbox utilized in accordance with the present invention is shorter than the open headbox of the conventional inclined-wire papermaking machines and is provided with a smoothly contoured wall insert 46 to reduce the volume of the highly dilute fiber suspension in the headbox and enable it to flow rapidly through the headbox toward the web forming area. The reduced volume headbox with its smooth contour not only increases the velocity of the fiber suspension traveling therethrough but also increases the level of random turbulence immediately over the forming zone. The increased level of turbulence prohibits the accumulation of foam and fiber masses that would otherwise float to the surface and form "haystacks" or other fiber defects. As will be appreciated, flow control of the dilute fiber dispersion can be achieved by a suitable flow control mechanism, such as the variable speed fan pump 48, provided, however, that the pump is of smooth configuration and free of elements that would produce eddies in the flow or otherwise cause fiber entanglement. Thus, the headbox utilized in accordance with the present invention prevents holding of the fiber dispersion for a prolonged period of time, thereby preventing the dispersed fibers from recombining to form defects in the sheet structure.

The fibers within the highly dilute uniform fiber suspension fed to the headbox are rapidly collected on the inclined traveling wire 38 as the dispersing media flows through the wire. The collected dispersing medium free from fibers, called "white water," is then recirculated within the system with a portion of the white water being returned to the inlet chute 12 of the in-line disperser through the conduit 20 under the pumping action of the pump 50. The bulk of the white water is driven through conduit 42 by pump 52 to the diluting station 40 where it is used to dilute the fiber dispersion flowing from the in-line disperser 14.

The fibrous web material continuously formed on the papermaking machinery is, as mentioned, a light weight material having a uniform fiber formation. The uniformity of the fibers within the sheet material can be judged visually and subjectively by looking through the sheet by a uniform light source. As mentioned in the technical literature relating to web formation, such as the multi-volume work of James P. Casey entitled *Pulp and Paper* (Interscience, New York, 2nd Edition, 1961), particularly at Volume 3, pages 1277–1279, fibrous web material "is said to have a uniform or close formation if the texture is similar to ground glass when viewed in transmitted light. The formation is said to be poor or wild if the fibers are unevenly distributed, giving the sheet a mottled or cloudy appearance in transmitted light." The results of such visual examination cannot be expressed numerically, particularly since the apparent uniformity of formation is affected by the transparency of the paper whereby the more transparent the paper, the more readily poor formation is apparent. Although complex and expensive photoelectric scanning devices have been used in some instances to measure web formation, Casey also mentions the use of a procedure for evaluating the microvariation and macrovariation in basis weight as a technique for measuring the uniformity of the fibrous web material.

As used herein, the "microvariation in basis weight" is the average arithmetic variation in weight of an equal number of identically sized samples taken from regions of apparent high and low density. It is determined by cutting and weighing five ½ inch diameter samples from regions of apparent high and low density. All the samples are cut from a one square foot randomly selected portion of the web material. By determining the average arithmetic variation in the weights of the ten samples, the microvariation in the basis weight can be determined. Using this technique, it has been found that the glass fibrous web material of the present invention exhibits a microvariation of less than 10% with an average variation in the range of about 0.75% to 4.2% at basis weights of 17–45 gsm. The percentage variation was calculated by dividing the difference between the mean weight of all the samples and the individual weight measurements by the mean weight. In this connection, it has been found that the microvariation for glass webs produced in accordance with prior art techniques has fallen within the range of 21 to 33%. For example, two glass sheets made in accordance with the teaching of U.S. Pat. No. 3,622,445 exhibited average microvariations of 31.5% and 29.6% as basis weights of 45 gsm and 19 gsm, respectively, while three glass sheets made in accordance with the teaching of U.S. Pat. No. 3,749,638 exhibited average microvariations of 32.8%, 21.6% and 22.4% at basis weights of 44 gsm, 19 gsm and 17 gsm, respectively.

The expression "macrovariations in basis weight" is the coefficient of variation in weight of a number of larger samples taken from a larger area. It is determined by randomly selecting three one foot square samples from a one yard by two yard sample. Thirty-one 1 inch diameter samples are taken in a scattered pattern from each one foot sample. The coefficient of variation of the weights of the ninety-three 1 inch diameter samples is then calculated to determine the macrovariation. The glass web material produced in accordance with the present invention exhibited a coefficient of variation well below 5% as shown in the following table.

TABLE

MACROVARIATION OF BASIS WEIGHT

| | U.S. Pat. No. 3,622,445 | U.S. Pat. No. 3,749,638 | Application |
|---|---|---|---|
| Mean Wt. (gm) | 0.0244 | 0.0201 | 0.0235 |
| Std. Dev. (gm) | 0.0030 | 0.0021 | 0.0004 |
| Maximum Wt. (gm) | 0.0340 | 0.0273 | 0.0246 |
| Minimum Wt. (gm) | 0.0172 | 0.0155 | 0.0226 |
| Wt. Range (gm) | 0.0168 | 0.0118 | 0.0020 |
| Samples (n) | 93 | 93 | 93 |
| Coef. Var. | 12.3% | 10.5% | 1.7% |

Another method of determining the uniformity of the web material of the present invention is by measuring the thickness of the web material. Using a Model No. 549 TMI gauge with a 0.6 inch diameter anvil and 7–9 psi pressure, it is possible to obtain measurements of the thickness of the web material to a sensitivity of 1/10,000 of an inch. By obtaining random measurements of the thickness of the web in areas of apparent uniformity and in areas of apparent fiber defect, it is possible to measure the thickness variation in the defect locations. Using this technique, it has been found that minor defects can be categorized as accumulations or agglomerations of fibers that are visually apparent and cause a local difference in web caliper up to 0.0005 inch. Major defects are accumulations or agglomerations of fibers that are visually apparent and cause a local difference in web caliper greater than 0.005 inch or more. Using this technique to identify and categorize fiber defects, it has been found that the glass fiber web material of the present invention exhibits an isolated multi-fiber defect count of less than 10 per 100 square feet (considering only the major defects) and usually a major defect count of about 3 or less per 100 square feet.

The following examples are given in order that the effectiveness of the present invention may be more fully understood. These examples are set forth for the purpose of illustration only and are not intended to in any way limit the practice of the invention. Unless otherwise specified, all parts are given by weight.

EXAMPLE I

A light weight glass fiber web material was produced using production size, papermaking machinery. Glass fibers having a fiber diameter of 9 microns were cut to a length of ½ inch from strands of glass rovings fed from bobbins. The cut fibers were delivered directly to an in-line disperser at a rate of one pound per minute. The in-line disperser has a capacity of 100 gallons, a relative impeller ratio of 0.8 in./gal. and was operated at a through-rate of 30 gallons per minute, thus providing a dwell time of slightly more than 3 minutes. The dispersing media used was a dilute sulphuric acid solution containing a guar gum derivative (Gendriv-492 SR) in amounts sufficient to provide a solution viscosity of about 5 cps at a pH of 2.3 and a temperature of 88° F. The fiber dispersion at a fiber consistency of 0.4 percent was fed from the disperser to a mix tank where the fiber consistency was diluted at a ratio of approximately 24:1. Polyvinyl alcohol fibers were added to the dilute suspension in amounts sufficient to provide a polyvinyl alcohol fiber concentration of 8% based upon the weight of the glass fibers. The fiber dispersion was then fed to a low volume high velocity headbox at a consistency of 0.017% and a glass fiber web was formed at a medium speed production rate.

The resultant web material had a basis weight of 13.6 gsm, a thickness of 84 microns and an air porosity of 8263 liters per minute per 100 $cm^2$ at 12.7 mm. $H_2O$ pressure. The light weight web had a dry tensile strength of 507 gm/25 mm. in the machine direction and 333 gm/25 mm. in the cross direction. It exhibited tongue tear of 34 gms in the machine direction and 44 gms in the cross direction.

Samples taken from various portions of the sheet material exhibited a major defect count of 0–2 and a minor defect count of 0–5 per 100 square feet, corrected to a basis weight of 17 grams/square meter. A major defect is categorized as a multi-fiber grouping either of an undispersed or partially dispersed nature or of a haystack configuration having a thickness variation of 0.0005 inch or more, while a minor defect is categorized as two or three fibers which have remained undispersed or been drawn together and have a thickness variation up to 0.0005 inch. Commercially acceptable light weight materials are considered those which have about 10 or less, and preferably 5 or less, major defects per 100 square feet of web material. The minor defects are not considered significant. The sheet material also exhibited a uniform fiber distribution substantially free of any density variation upon a visual examination.

EXAMPLES II–VI

The procedure of Example I was repeated on the same papermaking machine except for variations in the process operating conditions, the fiber furnish and the basis weight of the material produced. The results are tabulated below:

TABLE

| | Ex. II | Ex. III | Ex. IV | Ex. V | Ex. VI |
|---|---|---|---|---|---|
| Fiber | | | | | |
| 9 micron (%) | 70 | 46 | 90 | 70 | 22 |
| 13 micron (%) | 22 | 46 | — | 22 | 70 |
| Binder | 8 | 8 | 10 | 8 | 8 |
| Basis weight ($gm/m^2$) | 19.8 | 18.3 | 22.0 | 22.4 | 23.1 |
| Thickness (microns) | 123 | 115 | 133 | 138 | 115 |
| Air porosity (1/min.) | 5648 | 6552 | 4742 | 5512 | 6149 |
| Dry tensile (gm/25 mm) | | | | | |
| MD | 1109 | 609 | 1828 | 1456 | 1121 |
| CD | 915 | 765 | 1034 | 1362 | 1037 |
| Tongue tear (gms) | | | | | |
| MD | 51 | 60 | 40 | 62 | 89 |
| CD | 51 | 44 | 60 | 63 | 99 |
| Defect Count per 100 $ft.^2$ | | | | | |
| Major | 0–3 | 0–4 | 0–3 | 0–1 | 0 |
| Minor | 3–4 | 0–5 | 7–13 | 1–4 | 2–4 |

EXAMPLES VII–IX

The procedure of the preceding examples was repeated on a small size production machine using finer diameter glass fibers and no binder fiber. In each instance, the glass fibers constituted 100 percent of the fiber component and were ½ inch in length and 6 microns in diameter. The basis weight and defect count per 100 square feet are given below. The high minor defect count reflects the very fine fiber diameter and the subjective determination of the analyst but in each instance is considered a perfect sheet material from a commercial standpoint.

| Ex. | Basis Weight ($gm/m^2$) | Defects Major | Defects Minor |
|---|---|---|---|
| VII | 15.8 | 1 | 222 |
| VIII | 16.6 | 0 | 356 |
| IX | 17.6 | 0 | 198 |

EXAMPLE X

A continuous fibrous sheet material was formed from a fiber furnish consisting of 67.5% by weight glass fibers of 9 micron diameter and ½ inch length, 22.5% by weight polyester fibers of 1.5 dpf having a length of ¼ inch and 10% by weight of polyvinyl alcohol fibers. The glass fibers only were dispersed in the in-line disperser of the type used in the previous examples; namely, a multicompartment unit wherein the fibers and dispersing medium continuously flow directly through the unit from one compartment to the next. The unit has a relative impeller ratio of 0.4 in/gal and was operated at a throughput of 1.56 ton per day. The glass fiber dispersion was carried out using water as the dispersing medium with the water adjusted to a viscosity of 8 cps using 0.1% of a guar gum derivitive (Gendriv 492 SR) and 0.075% sodium hexametaphosphate. The fiber consistency was 0.15% and the dwell time within the disperser was about 3.3 minutes.

The polyester and polyvinyl alcohol fibers were dispersed in a stock chest at a fiber consistency of 0.15% for a period of about 20 minutes. The polyester and binder fiber stock from the chest was blended with the glass fiber dispersion, diluted and fed to the headbox of a papermaking machine. Continuous web material was produced at a basis weight of 45 gsm and 22 gsm. The former material exhibited a microvariation in basis weight of 1.7% with variations ranging from 0 to 4.6% and a macrovariation in basis weight of 1.7%, while the latter material exhibited a microvariation in basis weight of 0.76% with variations ranging from 0 to 3.1%. Both materials had a visual defect count of 0.

EXAMPLE XI

The procedure of Example X was repeated except that the polyester fibers were eliminated; only 5% by weight polyvinyl alcohol fibers were used and the glass fibers had a diameter size of 6 microns. The resultant web material had a visual defect count of 0 and a microvariation in basis weight of 4.2%.

EXAMPLE XII

A sheet material was formed from 70% by weight polyester fibers of 1.5 dpf and ¾ inch in length and 30% wood fibers using the in-line disperser of the previous examples. The dry polyester fibers were fed to the inlet chute of the disperser by a textile fiber feeder and weighbelt. The dispersing fluid was water containing Separan AP-30 at a concentration of 0.016% resulting in a viscosity of 6 cps. The fluid exhibited a pH of 6.0 and was used at a temperature of 40° C. The dwell time of the polyester fibers in the disperser was 2.85 minutes. The procedure of the earlier examples was followed in producing a continuous web material that exhibited excellent fiber formation comparable to the glass webs of the earlier examples.

The foregoing procedure was repeated except that the viscosity modifier was hydroxyethylcellulose (Natrosol) at a concentration of 0.164% resulting in a viscosity of 5 cps. The resultant sheet material also exhibited excellent fiber formation.

EXAMPLE XIII

The procedure of Example XII was repeated using 100% by weight polyester fibers of 1.5 dpf and 1 inch length. The viscosity of the dispersing liquid was 10 cps, the dispersion was uniform and web material showed good formation.

EXAMPLE XIV

The procedure of Example XII was repeated but the polyester fibers were replaced with nylon fibers of 6 dpf and ¾ inch length. The relative impeller ratio remained at 0.8 in./gal. and the resultant dispersion was excellent. The web material exhibited no defects.

EXAMPLE XV

The procedure of Example XIV was repeated but the nylon fibers were replaced with polypropylene fibers of 1.8 dpf and ½ inch length. The resultant web material showed few defects.

As will be apparent to persons skilled in the art, various modifications, variations, and adaptations can be made from the foregoing specific disclosure without departing from the teachings of the present invention.

We claim:

1. A process of continuously producing a uniform fiber dispersion for wet papermaking operations from bundles of long fibers comprising the steps of: (1) providing an initial fiber slurry consisting essentially of a dispersing liquid having a viscosity of at least about 2 cps and long fibers in the form of at least partially unopened fiber bundles, the fibers in said bundles having a fiber length of about ¼ inch and more and a length to diameter ratio of about 400:1 to 3000:1; (2) continuously flowing said fiber slurry through an in-line dispersing chamber provided with a plurality of nonstapling impellers having an impeller blade diameter size relative to the capacity of the chamber of at least 0.1 in./gal., said impellers being adapted for generating trailing regions of reduced pressure and flow disruptive turbulence of high intensity, said slurry being fed continuously through said chamber at a throughput rate sufficiently faster than conventional papermaking fiber dispersing chambers to provide a chamber dwell time of only about ten minutes and less and a dispersion factor greater than 0.005, said factor being the quotient of said relative impeller size and the throughput rate of said slurry in tons per day; (3) subjecting said slurry to said regions with said turbulence being of sufficient intensity to rapidly open the fiber bundles and disperse the individual fibers during said dwell time within said chamber; and (4) removing the dispersed fibers and liquid from the chamber as a substantially uniform and homogeneous fiber dispersion for subsequent sheet formation in a wet papermaking operation.

2. The process of claim 1 wherein said relative impeller size is greater than 0.2 in./gal., and said dispersion factor is about 0.05–1.0.

3. The process of claim 1 wherein the dispersing liquid has a viscosity of at least 5 cps, said fibers having a length to diameter ratio of 700:1 to 2000:1 and said process includes the step of feeding dry fibers and said dispersing liquid to said disperser at a controlled rate, said fibers including inorganic and man-made synthetic organic fibers.

4. The process of claim 1 including the step of cutting dry fibers from strands of continuous filaments and feeding said dry cut fibers and said dispersing liquid to said disperser at a controlled rate.

5. The process of claim 1 including the steps of cutting and feeding dry fibers and said dispersing liquid to said disperser, said relative impeller size being greater than 0.2 in./gal., said dwell time being about 2–6 minutes and said dispersion factor being 0.05–1.0.

6. The process of claim 1 further including the steps of conveying the dispersion from the disperser to a sheet-forming area where the fibers in said dispersion are separated from the dispersing medium and collected as a continuous fibrous web, said dispersion being diluted prior to reaching said forming area.

7. The process of claim 1 wherein the dispersing liquid has a viscosity of at least 5 cps and said fibers have a length to diameter ratio of 1000:1 to 1600:1, said relative impeller size being about 0.2–1.0 in./gal., said dwell time being about 2–6 minutes and said dispersion factor being 0.1–0.5, said process further including the steps of conveying the dispersion from the disperser to a sheet-forming area where the fibers in said dispersion are separated from the dispersing medium and collected as a continuous fibrous web, said dispersion being diluted prior to reaching said forming area.

8. A continuous water-laid machine-made light weight inorganic fibrous web of uniform fiber formation comprising inorganic fibers having a fiber length of about ¼ inch or more and up to about 15% by weight of a binder for the inorganic fibers; said web having a basis weight of about 5–30 grams per square meter, a microvariation in basis weight of less than 10%, a macrovariation in basis weight of less than 5%, an isolated fiber bundle defect count of less than 10 per 100 square feet wherein each multi-fiber defect is an agglomeration of fibers causing a local difference in web thickness of 0.5 mils and more, and a visually perceptible uniform fiber distribution essentially devoid of "cloud effect" fiber density variations.

9. The fibrous web of claim 8 wherein the inorganic fibers are glass fibers.

10. The fibrous web of claim 8 wherein the inorganic fiber content is about 85 percent by weight or more.

11. The fibrous web of claim 8 wherein the web has a basis weight of about 10–25 grams/square meter.

12. The fibrous web of claim 8 wherein the inorganic fibers are glass fibers having a diameter in the range of 5–15 microns and a length in the range of ¼–1 inch.

13. The fibrous web of claim 8 wherein the inorganic fibers include a mixture of glass fibers of different micron diameter size.

14. The fibrous web of claim 8 wherein the inorganic fibers constitute about 90 percent by weight of the web and are glass fibers having a fiber diameter in the range of 5–15 microns, said web exhibiting a major defect count of less than 10 per 100 square feet.

15. The fibrous web of claim 8 having a major defect count of about 5 or less per 100 square feet.

16. The fibrous web of claim 8 wherein the binder is initially incorporated into the web in fiber form.

17. The fibrous web of claim 8 wherein the inorganic fibers are glass fibers having a diameter of less than 15 microns and a length of about one inch or less, said glass fibers constituting at least about 90 percent by weight of the web, the binder being of a thermoplastic material initially incorporated into the web in fiber form, said web having a basis weight of about 25 grams per square meter or less and exhibiting a major defect count of about 5 or less per 100 square feet.

* * * * *